US006336622B1

(12) United States Patent
Eilertsen et al.

(10) Patent No.: US 6,336,622 B1
(45) Date of Patent: Jan. 8, 2002

(54) TOWER

(75) Inventors: Bjørn Eilertsen, Hundvåg; John Daniel Madsen, Sandnes, both of (NO)

(73) Assignee: Engineering & Drilling Machinery AS, Stavanger (NO)

( * ) Notice: Subject to any disclaimer, the term of this patent is extended or adjusted under 35 U.S.C. 154(b) by 0 days.

(21) Appl. No.: 09/425,375

(22) Filed: Oct. 22, 1999

Related U.S. Application Data

(63) Continuation of application No. PCT/NO98/00130, filed on Apr. 23, 1998.

(30) Foreign Application Priority Data

Apr. 24, 1997 (NO) ..... 971885

(51) Int. Cl.[7] ..... F16H 29/02
(52) U.S. Cl. ..... 254/95; 254/DIG. 6
(58) Field of Search ..... 254/95, 96, 97, 254/DIG. 6, 427, 89 R, 45, 6 R, 6 B, 6 C; 74/500.5, 89.21

(56) References Cited

U.S. PATENT DOCUMENTS 2,131,261 A 9/1938 Aldeen et al.
2,170,595 A 8/1939 Povandra
2,251,308 A 8/1941 Washington
2,661,082 A * 12/1953 Ziegler ..... 254/DIG. 6
4,830,337 A * 5/1989 Ichiro et al. ..... 254/95
5,441,238 A * 8/1995 Lindsley ..... 254/95

* cited by examiner

*Primary Examiner*—Robert C. Watson
(74) *Attorney, Agent, or Firm*—Cowan Liebowitz & Latman P.C.; Michael I. Wolfson

(57) ABSTRACT

A derrick, especially a drilling rig derrick, including a derrick structure and lifting tackle for a load, for example, a drill string, in the derrick structure. The lifting tackle includes guideways in parallel relation which each includes a vertical main guide rail (4, 7), a storage guide rail (5, 8) parallel thereto, and in a lower portion of the derrick a connecting guide portion (6, 9) between the two said rails, a rack (10, 11) are slidably arranged in each guideway which racks (10, 11) are divided into successive, preferably hingedly interconnected rack segments (12, 13) designed to bear against one another when the rack (10, 11) or when a part thereof is in the vertical main guide rail (4, 7) the main guide rail (4, 7) being designed for horizontal support of the rack segment (12, 13), a load-being yoke (22) supported on the rack (10, 11) in the respective vertical main guide rails (4, 7), and a driving gear (25) including a driving gearwheel (26, 27, 28) in driving engagement with the rack (12, 13), in the respective vertical guide rails (4, 7).

15 Claims, 9 Drawing Sheets

TOWER

CROSS-REFERENCE TO RELATED APPLICATION

This application is a continuation of pending international application PCT/NO98/00130, filed on Apr. 23, 1998.

BACKGROUND OF INVENTION

The invention relates to a derrick, in particular a drilling rig derrick, comprising a derrick structure, and lifting tackle for a load, for instance, a drill string, in the derrick structure.

An essential function in a drilling rig derrick is vertical movement of loads, primarily the drill string and its sections, and lowering and retrieving equipment, for example a BOP (blowout preventer), with the aid of a drill string.

Drawworks, wires and blocks are used in conventional drilling rig derricks. More recently, drilling rig derricks have been produced where the load handling takes place with the aid of hydraulic cylinders in combination with wires and blocks. There are also known proposals to use driving gears having a motor or motors coupled to gearwheels which climb on vertically mounted racks in the derrick.

The last-mentioned solution has the advantage over wire systems that the wire as a load-bearing element is eliminated. A wire will stretch under load. In today's wire systems in drilling rig derricks it is therefore necessary to monitor the wires and replace them at regular intervals in order to maintain the desired precision in the lifting tackle.

A problem in connection with the art using driving gears with motors/gear boxes coupled to gearwheels which engage with racks is that motors having gear boxes/gearwheels climb along the rack, thus requiring the power supply to be provided by means of a flexible hose or cable and the weight of the motors or driving gear to be lifted in addition to the load that is lifted.

The last-mentioned disadvantage can be obviated by making the lifting tackle in such manner that it is not the driving gear which climbs up along the racks, but the racks which are moved up and down by the driving gear.

There are known devices for movement, especially hoisting and lowering of loads, using a driving gear which includes a gearwheel in engagement with a rack that is divided into successive and hingedly interconnected rack segments which run in a guideway, see for example U.S. Pat. No. 1,870,244, U.S. Pat. No. 1,916,517 and U.S. Pat. No. 2,170,595.

In these known devices, the rack segments are locked in the straight, vertical lifting line, and the lifting devices involved are intended for relatively short lifting or jacking lengths. The rack segments are stored horizontally.

It is an object of the present invention to provide a lifting/driving device which is intended for practically endlessly long travel, and almost unlimited capacity in terms of running power and speed.

A particular object of the invention is to provide a lifting device having rack segments which can be moved up and down with the aid of a driving gear and where the rack segments in the vertical, load-bearing straight line are prevented from buckling/bending.

It is also an object of the invention to provide a derrick, in particular a drilling rig derrick, where the load handled by the lifting tackle is taken up at the bottom of the derrick.

It is also an object of the invention to provide a derrick, in particular a drilling rig derrick having a lighter and simpler structural design, where the derrick structure is primarily proportioned for horizontal forces.

A particular object of the invention is to provide a drilling rig derrick for use on board a floater, for example, a drilling ship, which derrick has a centre of gravity that has been lowered radically in comparison to conventional drilling rig derricks.

A particular object of the invention is also to provide a drilling rig derrick where the lifting tackle, as occasion requires, can be used to press the drill string or pipe string.

It is also an object of the invention to provide a derrick, especially a drilling rig derrick, which can be extended according to need in a simple manner.

SUMMARY OF THE INVENTION

These and other objects of the invention are attained with a derrick, especially a drilling rig derrick, including a derrick structure, and lifting tackle for a load, for example, a drill string, in the derrick structure, which derrick is characterised in that the lifting tackle comprises vertical guideways in parallel relation, each including a vertical main guide rail, a storage guide rail parallel thereto, and a connecting guide portion between the two said rails arranged in a lower portion of the derrick, a rack slidably mounted in each guideway, which racks are divided into successive, hingedly interconnected rack segments designed to bear against one another when the rack or a part thereof is in the vertical main guide rail, said main guide rail being adapted for horizontal support of the rack segments, a load-bearing yoke supported by racks in the respective vertical main guide rails, and a driving gear including a driving gearwheel in driving engagement with the racks in the respective vertical main guide rails.

Advantageously, the racks may have teeth on two parallel sides.

A lifting tackle according to the invention can in practice be designed so as to be a very precise mechanism. The load will be taken up at the bottom of the derrick, where the driving gear is located. This gives the possibility of a lighter (in terms of weight) derrick structure, where the taking up of horizontal forces is given importance.

Because the load is taken up at the bottom of the derrick, and because the derrick can be built so as to be lighter, the centre of gravity of the derrick will be lowered, which is important and represents a great advantage when used on board floaters, for example, drilling ships.

Advantageously, the lifting tackle may also be used to press, for example, a pipe string. when the load-bearing yoke is connected to the racks.

Initially, the lifting height will be determined by the number of rack segments. The rack segments which do not form a part of the vertical, supporting rack, will be stored in the vertical storage guide rail.

The rack segments can be made so as to rest on top of one another on straight surfaces, and the horizontal support results in their being prevented from buckling/bending.

The derrick structure can be extended or shortened in a simple manner by adding or taking away a derrick segment.

When needed, additional rack segments can be inserted into the rack segment train, or optionally taken out.

The connecting portion between the main guide rail and the storage guide rail may be made in the form of a curved guideway portion, but it is especially advantageous if the connecting portion can include an idler wheel pivotally supported about a horizontal axis and having a periphery in contact with the rack segments which are in the connecting guide portion. It is particularly advantageous if the idler wheel has an elastic peripheral coating, for example, of a suitable rubber material.

An idler wheel of this kind will provide favourable transport of the rack segments in this U-shaped portion of the guideway. The elastic peripheral coating gives smooth contact between the idler wheel and the rack segments and serves to take up smallish dimensional deviations and will prevent jerking and a tendency to swinging motions in the segment train formed by the rack segments.

It is especially advantageous if each individual rack segment is made in the form of an H-beam, with teeth on the parallel flange sides of the H, whereby smooth drive actuation of the rack segments can be obtained with the aid of driving gearwheels which act on both sides of the rack segment.

It is particularly advantageous according to the invention if synchronisation is employed which includes gearwheels that are in engagement with the rack in the storage guide rail and are capable of drive connection with gearwheels that are in driving engagement with respective driving gearwheels in the driving gear. This makes possible a synchronisation of the movements of the rack segments in the two vertical guide rails.

According to the invention, there may be provided a tension adjusting device which serves to tension the rack segments against the idler wheel, so that a desirable and favourable abutting interaction is obtained between the periphery of the idler wheel and the rack segments in this portion of the guideway.

The gearwheel that is in mesh with the rack in the storage guide rail may be supported so as to be position-adjustable, to allow a tensioning of the interaction between the rack segments and the idler wheel, or more advantageously: the idler wheel may be adjustably supported for such tensioning.

The drive connection between the respective gearwheel which is in engagement with the rack in the storage guide rail and the gearwheel which is in driving engagement with a respective driving gearwheel, advantageously includes a universal shaft and optionally shaft couplings.

It is particularly advantageous if the driving gear according to the invention includes a driving motor for each driving gearwheel.

To secure synchronous operation of the driving motors, it is of advantage if directly opposite motors in the driving gear are drive-connected by means of a respective drive shaft.

In the case of a drilling rig derrick that is to be used on board a floater, it will be necessary to include a heave compensator in the lifting gear. Such heave compensation can, according to the invention, be obtained by allowing each rack to be attached to at least one driving gearwheel which is drive-connected to an electromotor and at least one driving gearwheel which is drive-connected to a hydraulic motor, which hydraulic motor is connected to a hydraulic accumulator connected to a hydraulic accumulator system having a low pressure feed pump. The arrangement may be so designed that is when a hoist load moves downwards the hydraulic motors act as pumps and charge the accumulators and when the hoist load moves upwards act as motors, power being drawn from the accumulators.

The racks will often, for example, in a drilling rig derrick, be in a tough environment and it will therefore be advantageous to have guideways which are shielded from the environment, whilst the guideways are designed for shielded movement of the load-bearing yoke in the main guide rails.

According to the invention, the shielding of the load-bearing yoke may include a respective canvas element actuated by the load-bearing yoke wherein there are embedded magnetically actuatable particles, magnets being mounted on the main guide rail to hold the canvas element in place on the main guide rail so that it covers the guideway In a preferred embodiment, rollers are provided on the load bearing yoke which interact with the canvas element and force this away from the guideway, or put it in place again when the load-bearing yoke moves along the guideway.

BRIEF DESCRIPTION OF THE DRAWING

The invention will now be explained in more detail with reference to the drawings, wherein.

DESCRIPTION OF THE PREFERRED EMBODIMENTS

Figure 1:
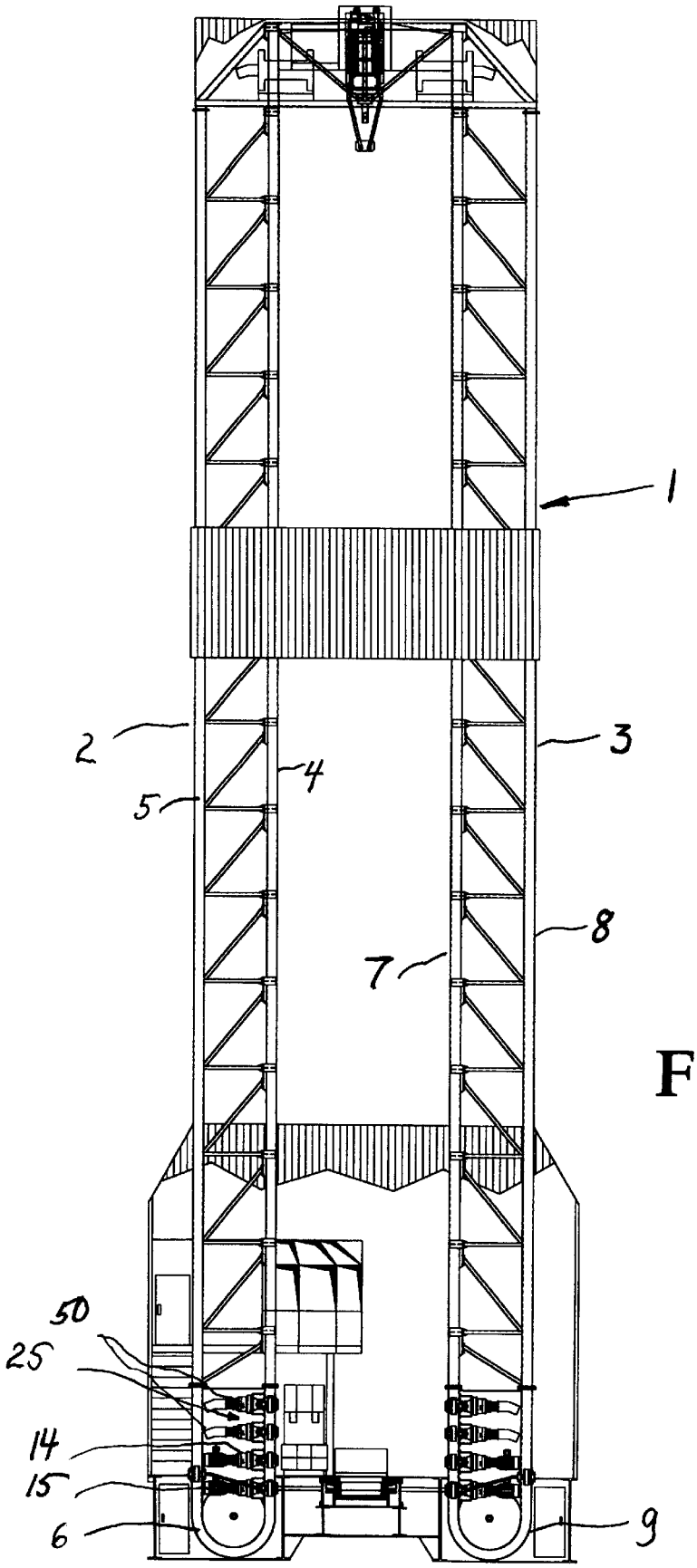
FIG. 1 is a sectional elevation of a derrick.
Figure 2:
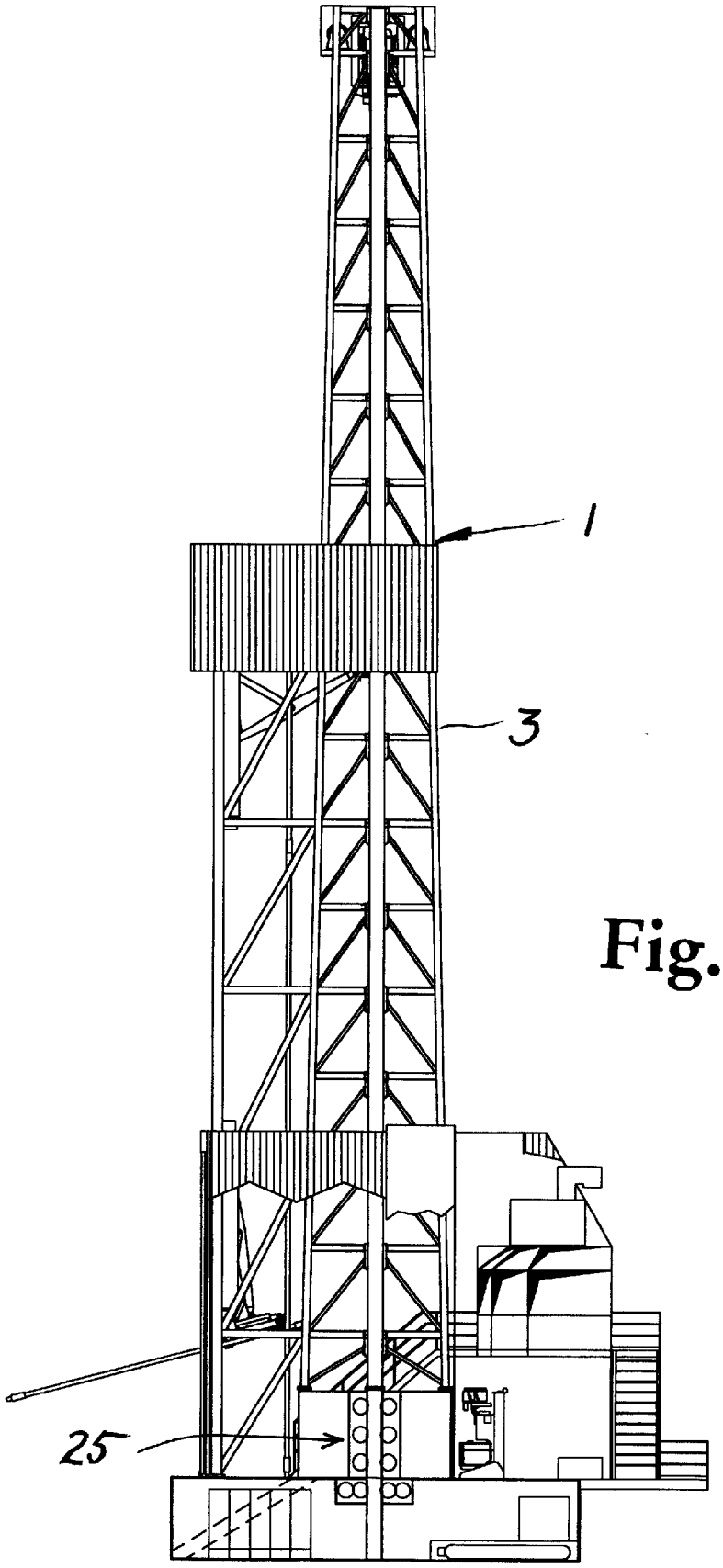
FIG. 2 is a side view of the same derrick.
Figure 3:
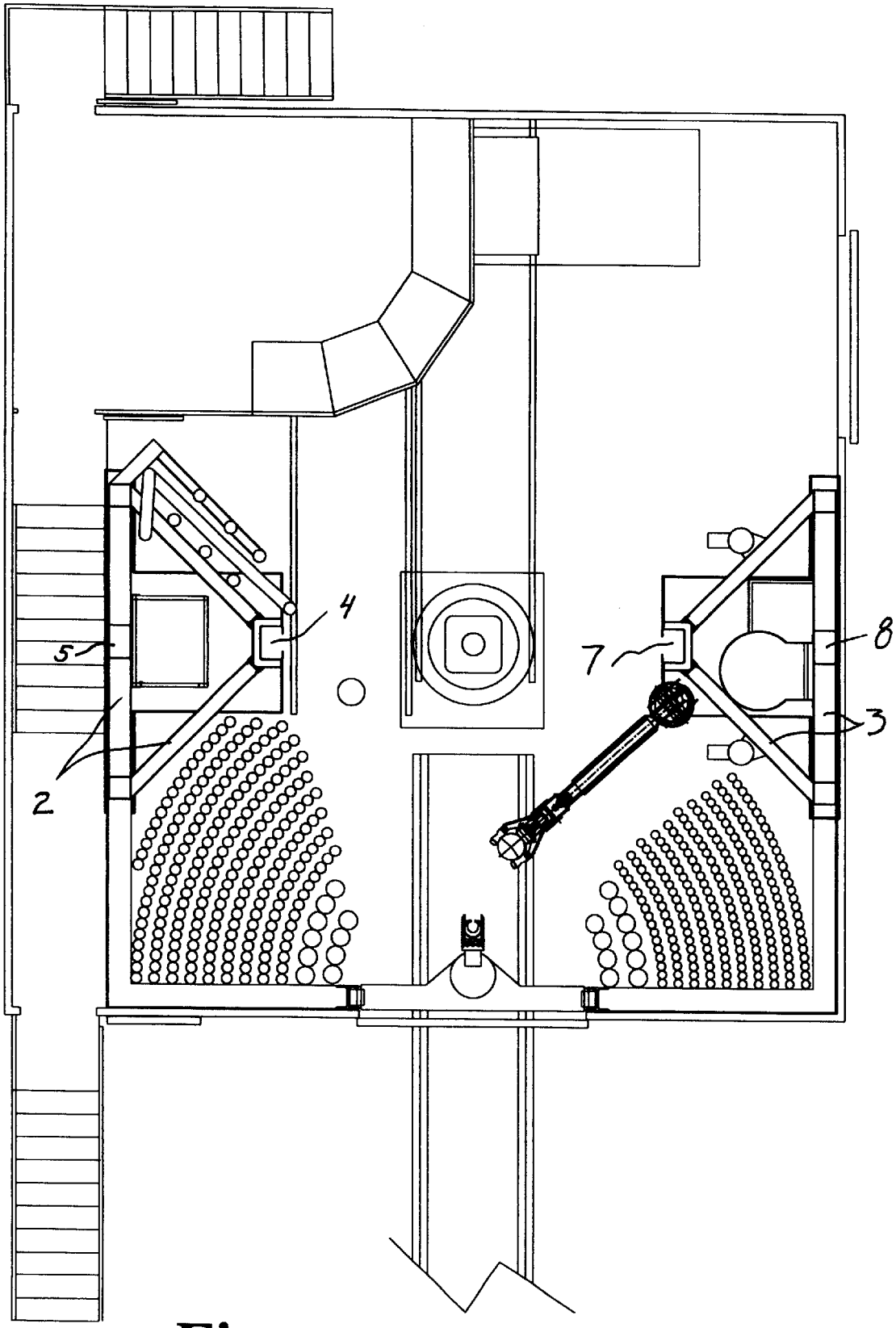
FIG. 3 is a (sectional) plan view of the derrick, in a larger scale.

FIGS. 1, 2 and 3 show a drilling rig derrick into which the invention has been incorporated. The drilling rig derrick 1 illustrated in FIGS. 1 and 2 consists essentially of two derrick structures 2 and 3, both constructed in a known way in the form of latticed structures. Each derrick structure 2, 3 includes a vertical guideway. Below, essentially only the derrick structure 2 and its components will be described in more detail, as the two derrick structures 2, 3 are identical. In the derrick structure 2, the vertical guideway includes a vertical main guide rail 4, a storage guide rail 5 parallel thereto, and a connecting guide portion 6 in the bottom portion of the derrick. The derrick structure 3 likewise has a vertical guideway which includes a vertical main guide rail 7, a storage guide rail 8 parallel thereto, and a connecting guide portion 9 between the main guide rail and the storage guide rail arranged in the bottom portion of the derrick.

In the respective guideways 4 to 6, 7 to 9, there is slidably arranged a respective rack 10, 11. This is shown in particular in the schematic FIG. 9. Each rack 10, 11 consists of successive rack segments 12, 13.

Figure 4:
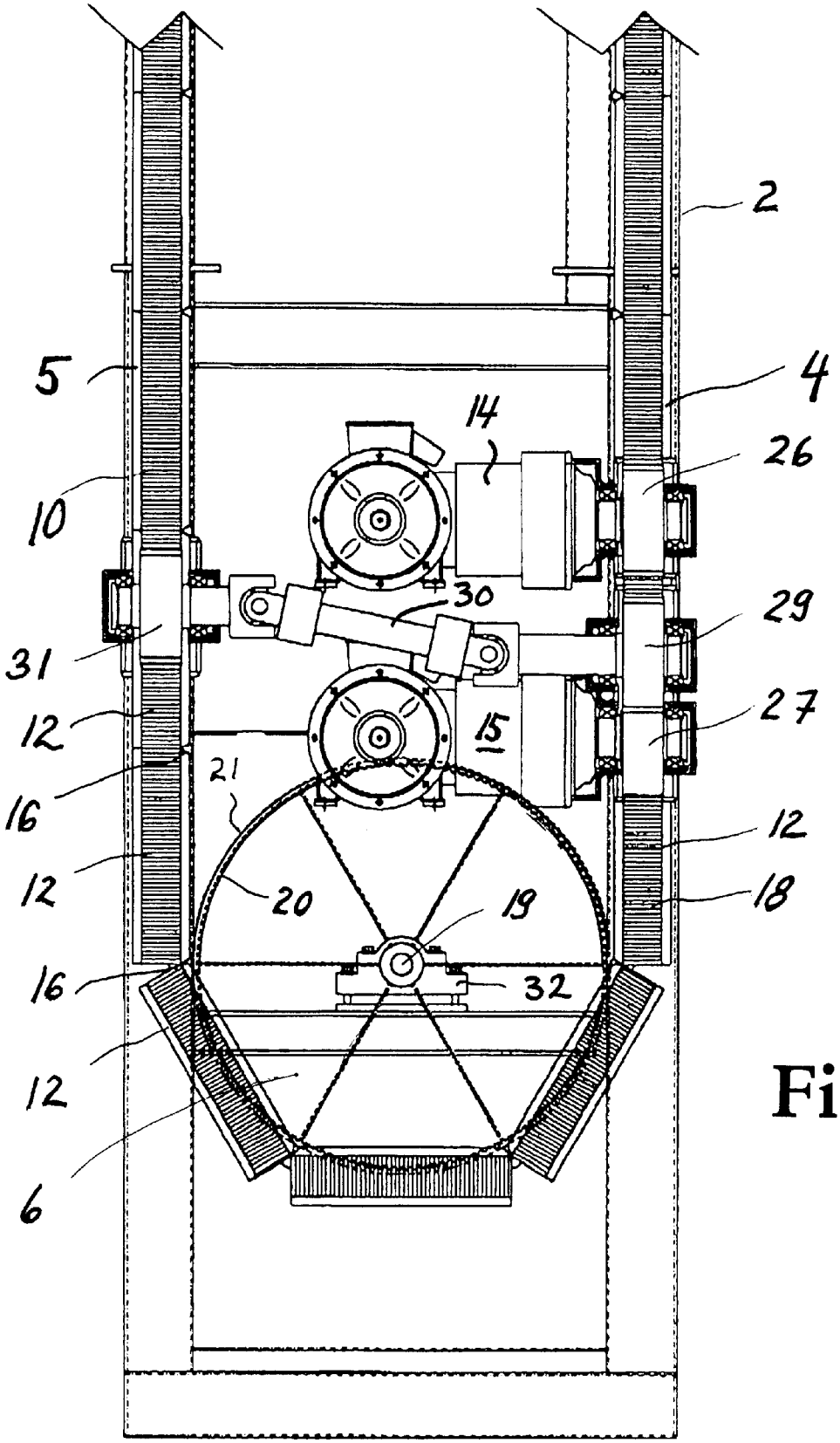
FIG. 4 is a section of the idler wheel area in the derrick.

FIG. 4 shows a section of the idler wheel area 6 in the guideway 4–6 in the derrick structure 2. From FIG. 4 it can be seen that the rack 10 consists of hingedly interconnected 16 rack segments 12. These rack segments 12 are designed to bear against one another when the rack 10 or a part thereof is in the vertical main guide rail 4. The main guide rail 4 is designed and proportioned for horizontal support of the rack segments 12, so that the rack 10 will be safeguarded against buckling/bending in the main guide rail.

Figure 5:
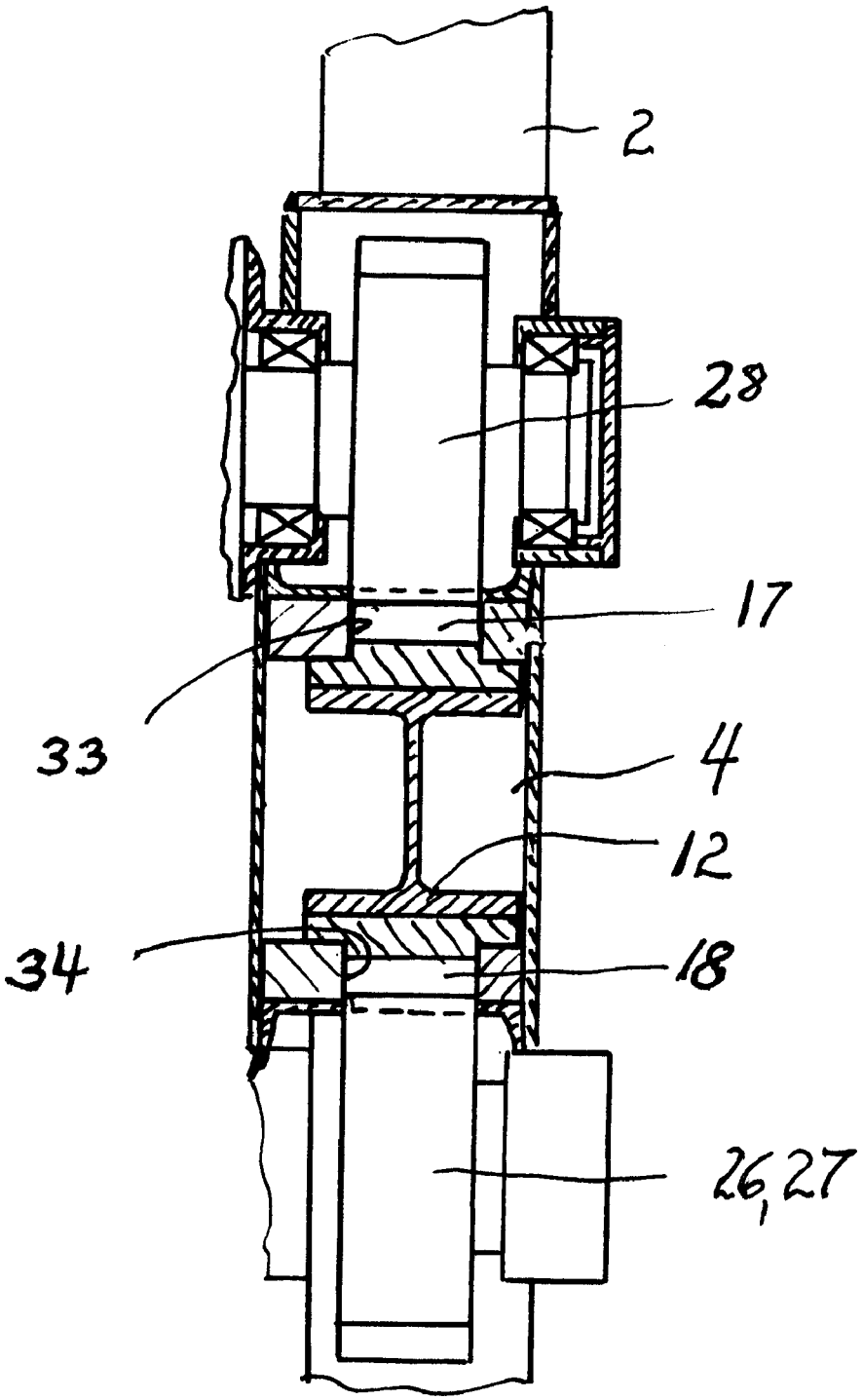
FIG. 5 is a horizontal section through a main guide rail with driving gearwheels.
Figure 6:
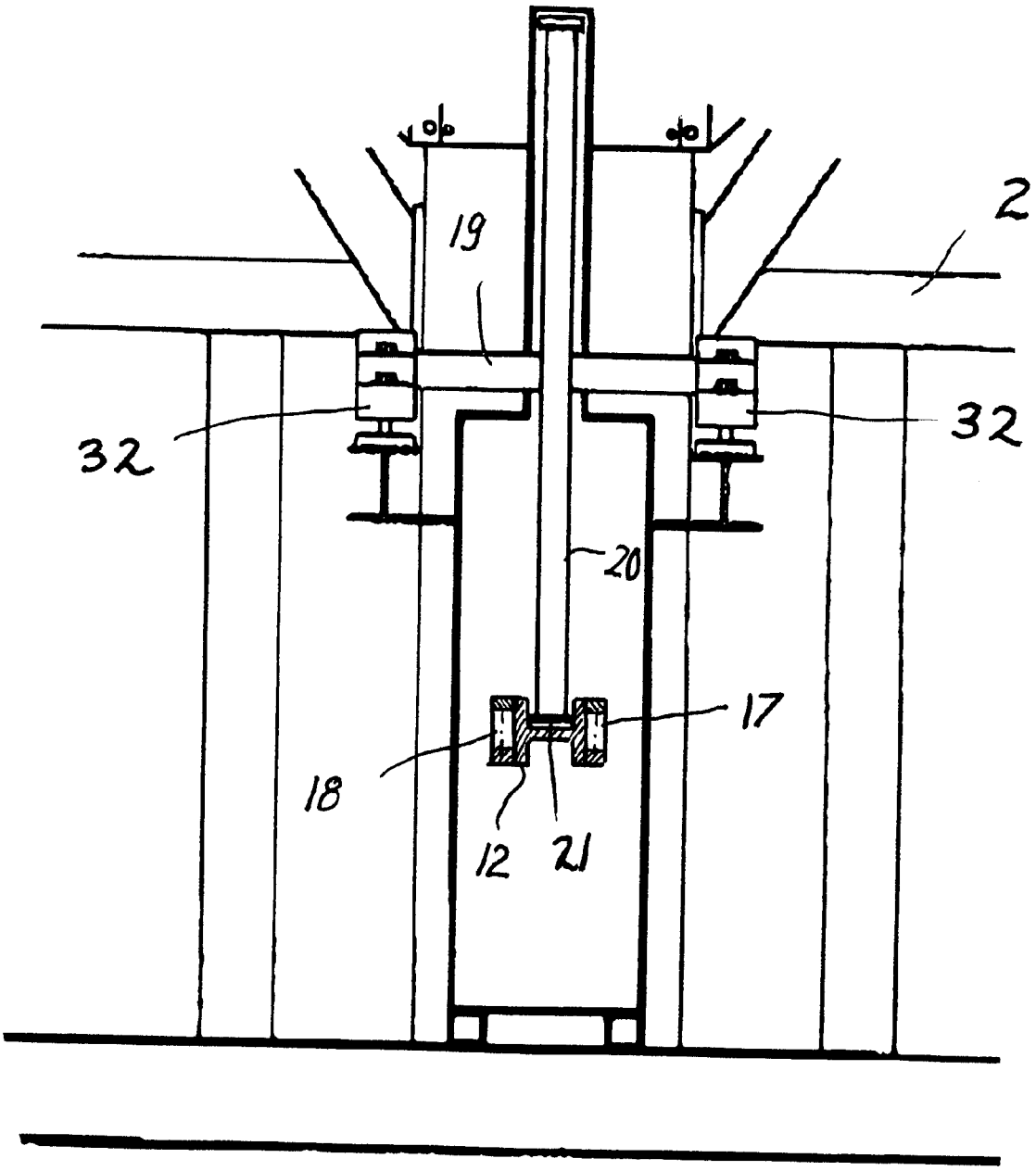
FIG. 6 is a vertical section through an idler wheel area.

The individual rack segment 12 is made having an H-shaped cross-section, see FIGS. 5 and 6 in particular. Each rack segment 12 may thus be regarded as a relatively short H beam, on the flanges of which beam there are arranged rows of teeth 17, 18, such that the individual rack segment 12 and thus also the rack 10 consisting of the rack segments have teeth on two parallel sides.

Figure 9:
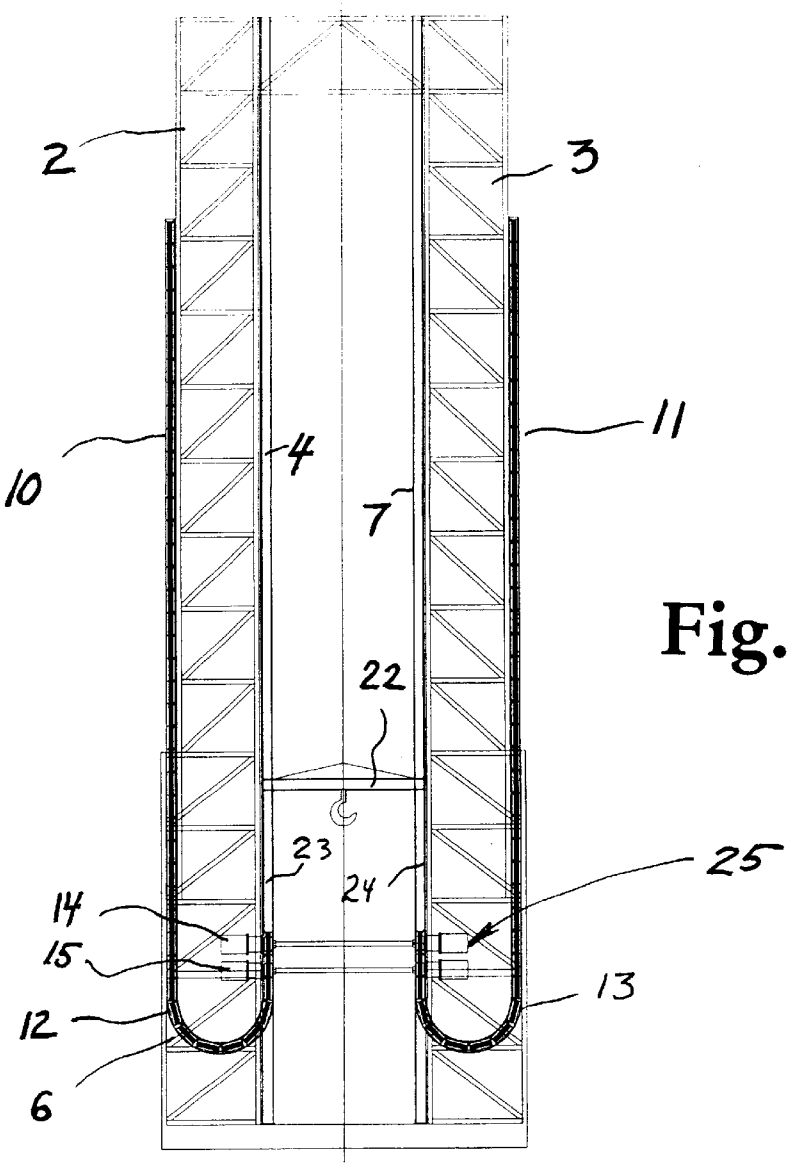
FIG. 9 is a simplified outline of the derrick of FIG. 1

In the exemplary embodiment, the connecting portion 6 is made in the form of idler wheel 20 pivotally supported about a horizontal axis 19. The idler wheel 20 has a periphery which both radially and laterally has contact with rack segments 12 which are in the connecting guide portion (FIGS. 4 and 6). The idler wheel 20 has an elastic peripheral coating 21, which runs against the bar in the H beam (the rack segment) 12. As illustrated in FIG. 9, the two racks 10, 11 are attached to a load-bearing yoke 22. The load-bearing yoke 22 rests on the racks 10, 11 in the two parallel, vertical main guide rails 4, 5 by means of suitable elongate bearing elements 23, 24 and will thus be capable of being raised or lowered by corresponding movement of the two racks 10, 11 in the respective guideway. For movement of the racks 10, 11 there is provided a driving gear 25 including a plurality of driving motors with driving gearwheels connected thereto which engage with the teeth 17, 18 on the rack segments 12, 13. The driving gear 25 includes a total of 16 driving motors—8 driving motors for each rack—, but for the sake of clarity in FIGS. 4 and 9 only the two lowermost driving motors 14, 15 on one side of the rack 10 are shown.

FIG. 4 shows two driving motors 14, 15 which each drive a driving gearwheel 26 and 27, respectively, which have driving engagement with the teeth 18 on the rack segments 12 in the rack 10. These driving gearwheels 26, 27 thus act on one of the long sides of the rack 10. Similarly, driving gearwheel 28 attached to non-illustrated driving motors is arranged on the opposite vertical side of the rack 10, in driving engagement with the teeth 17, as is shown in FIG. 5.

A gearwheel 29 is supported for engagement with the driving gearwheel 27. This gearwheel 29 is drive-connected by means of an intermediate cardan shaft 30 to a gearwheel 31 which is supported for driving engagement with the teeth 18 on the rack 10 in the storage guide rail 5.

The support of the respective driving gearwheels and gearwheels is merely indicated in FIG. 4, but it is understood that these driving gearwheels and gearwheels are supported in a suitable manner in the derrick structure 2. Of course, the same applies to the respective driving motors in the driving gear 25. A similar gearwheel 29 and gearwheel 31 are arranged on the other side of the rack 10, in mesh with a driving gearwheel and the teeth 17 on the rack 10, respectively.

The arrangement of the gearwheels 29, 31 and the intermediately connected cardan shaft 30 serves to provide synchronised movement control of the rack segment 12.

The idler wheel 20 is pivotally supported by means of its shaft 19 in position-adjustable bearings 32, so that the idler wheel 20 can be adjusted vertically, in order thereby to obtain the desired tension adjustment of the rack segment train in the connecting guide portion 6. The position adjustment of the two bearings 32 is only indicated here, but can be implemented simply with the aid of known nut/bolt tension adjusters.

With the aid of the driving gear 25, i.e., with the aid of the illustrated motors 14, 15 and the other similar motors that are not described in more detail, the racks 10, 11 may thus be moved up and down in the respective main guide rails 4, 7 for raising and lowering of the load-bearing yoke 22 (FIG. 9). The load-bearing yoke 22 may optionally rest directly on the racks 10, 11, that is, without the elongate bearing members 23, 23 and the load-bearing yoke 22 may rest loosely on the racks 10, 11 or be connected to these, so that downward movement of the racks 10, 11 in the main guide rails 4, 7 can be used to, e.g., press a pipe string with the aid of the load-bearing yoke.

In the exemplary embodiment, the driving gear 25 includes a plurality of hydraulic motors 50 (and the said electric motors 14, 15). In this way, it is easy to achieve a heave compensation system, and this is important in the case of floaters. The driving gear 25 hydraulic motors 50 are in a non-illustrated manner attached to a hydraulic accumulator system which includes a low pressure feed pump. The system will then function thus that when a hoist load (in the load-bearing yoke 22) moves downwards, the hydraulic motors 50 will act as pumps and charge the non-illustrated accumulator or accumulators. When the hoist load moves upwards, the hydraulic motors will function as such for hoisting, the power being drawn from the accumulators. When loads are lowered, the electric motors 14, 15 can be used as driving motors to drive the loadbearing yoke 22 downwards and thus charge the accumulators.

The two main guide rails 4, 7 are, as shown in FIG. 3, made in the form of rails that are C-shaped in cross-section, with an opening for the ends of the load bearing yoke, but in the area lowermost in the derrick, in proximity to the driving gear 25 and in the connecting portions 6, 13 an encapsulation has been made, and this can be seen in FIGS. 5 and 6. In the area in proximity to the driving gearwheels 26, 27, the rail 4 is made having suitable openings 33, 34 for the driving gearwheels, thereby enabling them to have driving engagement with the teeth 17, 18 on the rack segments 12 in this area The same is true of the gearwheels 21 in the storage guide rails 5, 8.

Figure 7:
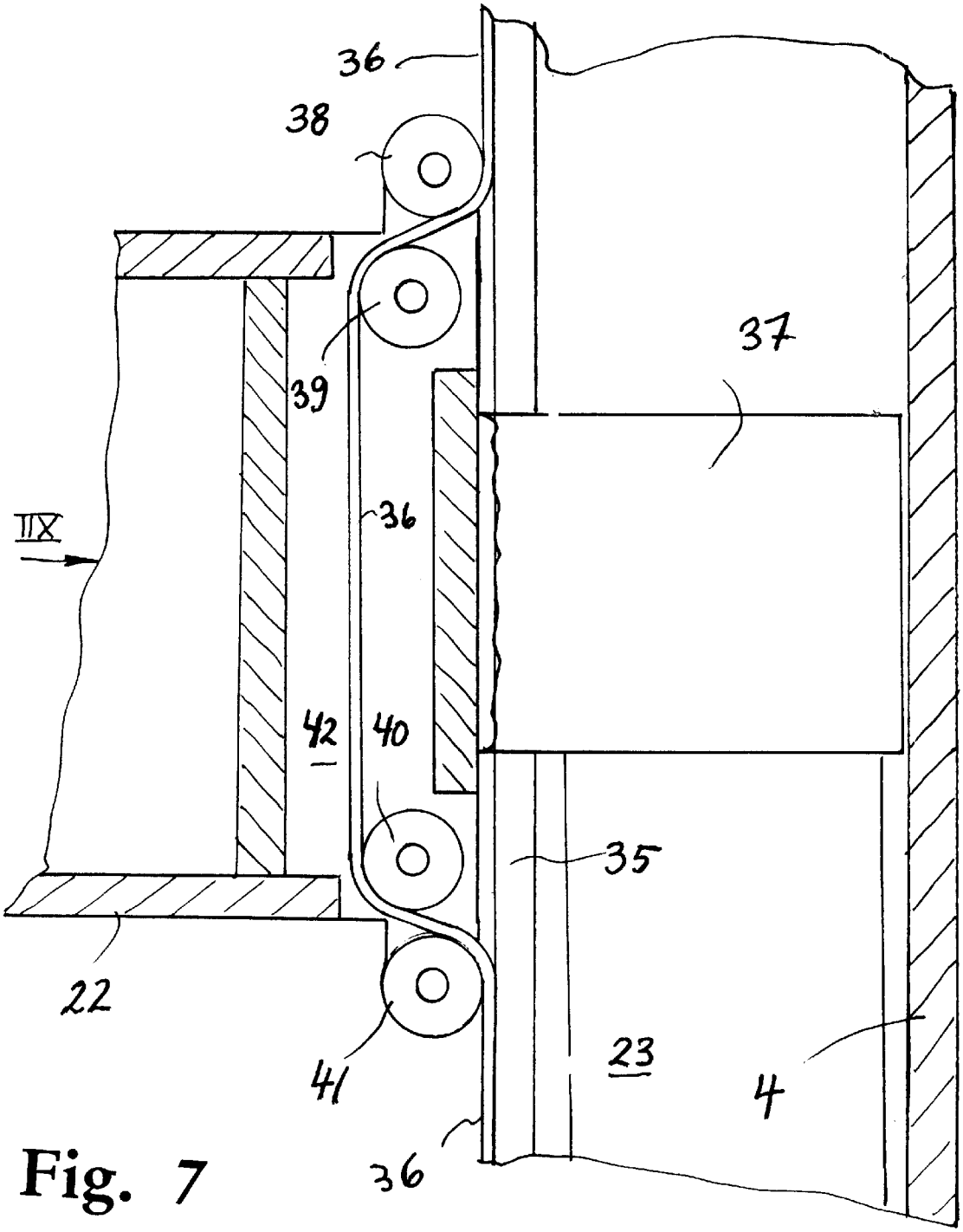
FIG. 7 is a vertical section through a load-bearing yoke and the attached guideway.
Figure 8:
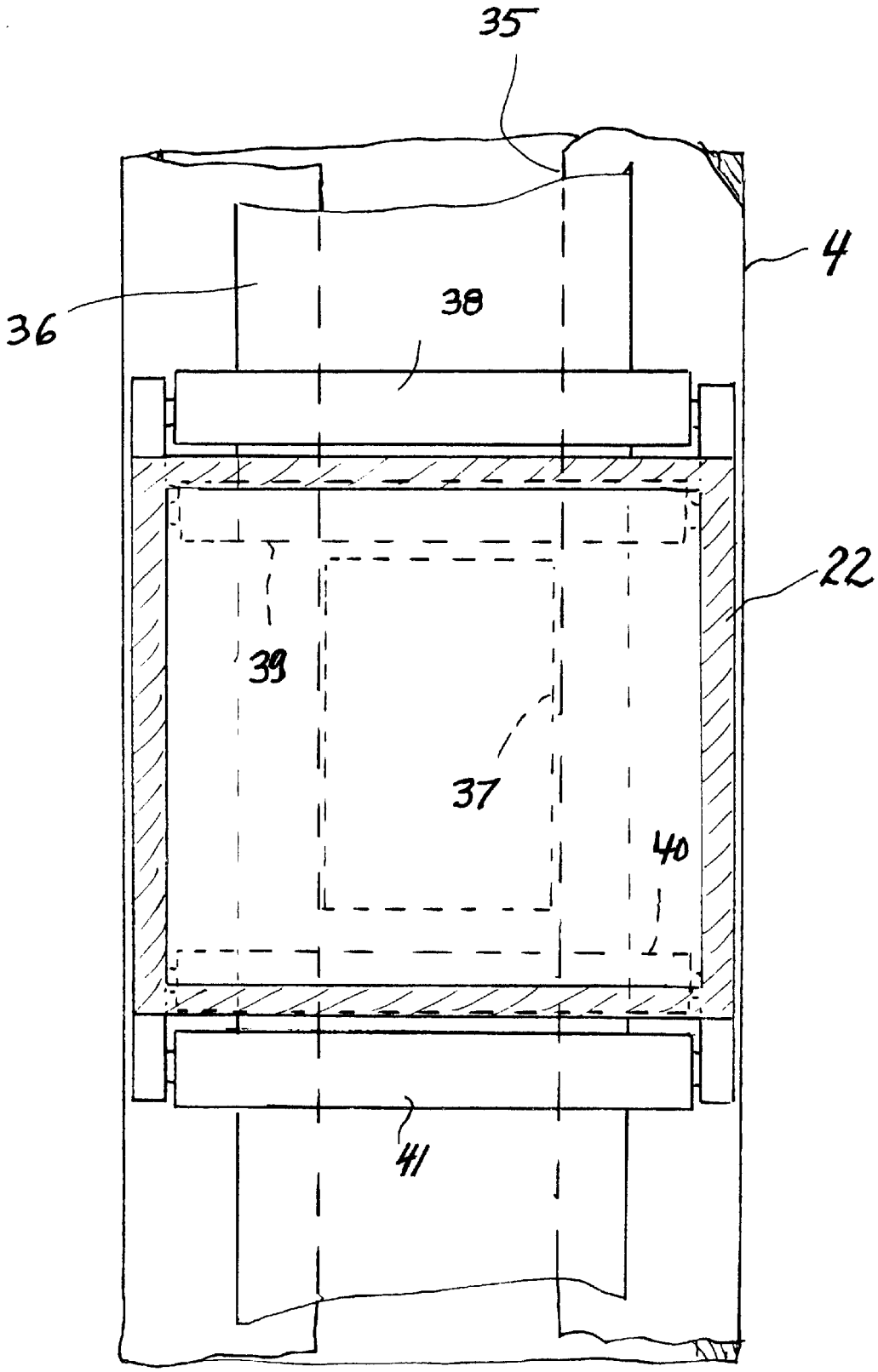
FIG. 8 is a vertical section through the load-bearing yoke seen in the direction of the arrow VIII on FIG. 7.

As mentioned, above the driving gear 25 the main guide rails 4, 7 are C-shaped in cross-section, as shown in FIG. 3, and as is also shown in FIGS. 7 and 8. The sliding surfaces in the respective main guide rail 4, 7 interact with sliding surfaces on the rack segments 12, 13 and in most cases it will be desirable to protect the inside space in the main guide rails, so that the sliding surfaces are not unnecessarily exposed to stresses from the surrounding environment.

Such shielding of the guideways may be done by arranging canvas elements which cover the open guide tracks 35 in the main guide rails. A canvas element 36 of this kind is shown in FIGS. 7, 8. The canvas element 36 has magnetic particles embedded therein, and on the main guide rail 4 there are mounted (not shown) magnets which will hold the canvas element 36 in place on the main guide rail 4 so that the canvas element covers the guide track or slot 35, which serves to introduce a respective end of the load-bearing yoke 33 in the rail 4, so that the load-bearing yoke has control in the derrick and contact with the racks 10, 11. The end of the load-bearing yoke 22 in FIGS. 7 and 8 is indicated by means of the reference numeral 37. As shown in FIGS. 7 and 8, on the load-bearing yoke there are arranged rollers 38, 39, 40, 41 which, in pairs, interact with the canvas element 36 and force this away from the rail 4, or put it in place again during the movement of the load-bearing yoke along the rails 4. As shown, the rollers are positioned such that the canvas element 36 is guided out from the rail 4 and through a slot 42 in the load bearing yoke 22. Above and below the load bearing yoke, the canvas element 36 will bear against the rail 4 and seal the inside space in the rail.

What is claimed is:

1. The derrick structure and lifting tackle for a load, including a drilling string, in the derrick structure, characterised in that the lifting tackle includes guideways in parallel relation which each include a vertical main guide rail (4, 7), a storage guide rail (5, 8) parallel thereto, and in a lower portion of the derrick a connecting guide portion (6, 9) between two said rails, a rack (10, 11) slidably arranged in each guideway, which racks (10, 11) are divided in successive, interconnected rack segments (12, 13) designed to bear against one another when the rack (10, 11) or when a part thereof is in the vertical main guide rail (4, 7), the main guide rail (4, 7) being designed for horizontal support of the rack segments (12, 13), a load-bearing yoke (22) supported on the racks (10, 11) in the respective vertical main guide rails (4, 7), and a driving gear (25) including a driving gearwheel (26, 27, 28) in driving engagement with the racks (12, 13) in the respective vertical guide rails (4, 7).

2. The derrick according to claim 1, characterised in that the rack elements (12, 13) have teeth (17, 18) on two parallel sides.

3. The derrick according to claim 1, characterised in that each connecting guide portion (6, 9) includes a horizontal axis and an idler wheel (20) pivotally supported about the horizontal axis (19) and having a periphery in contact with rack elements (12,13) which are located in the connecting guide portion.

4. The derrick according to claim 3, characterised in that the idler wheel (20) has an elastic peripheral coating (21).

5. The derrick according to claim 1, wherein at least one gear wheel (39) is in engagement with the rack (10) in the storage guide rail (4) and at least one driving gearwheel (27) and including at least one gearwheel (31) in storage guide rail (5) engaged with rack (11) and a shaft (30) for drive connecting gearwheel (3) with a respective driving gearwheel (27).

6. The derrick according to claim 5, a tension adjusting means for relative tension adjustment of the rack segments (12, 13) below the wheel (20).

7. The derrick according to claim 6, characterised in that the idler wheel (20) is supported so as to be position-adjustable for relative tension adjustment of the rack segments at the idler wheel.

8. The derrick according to claim 1, characterised in that the driving gear (25) includes a driving motor (14, 15) for each driving gearwheel (26, 27, 28).

9. The derrick according to claim 1, including directly opposing driving motors for the two racks (10, 11) are drive-connected to one another.

10. The derrick according to claim 9, wherein the driving motors that are at least one electromotor and a hydraulic motor with at least one driving gearwheel drive-connected to an electromotor and at least one driving gearwheel drive-connected to a hydraulic motor, and an hydraulic accumulator with the hydraulic motor coupled to a hydraulic accumulator.

11. The derrick according to claim 1 the guideways are sheltered from the surroundings and are adapted for shielded movement of the load-bearing yoke (22) in the main guide rails (4, 7).

12. The derrick according to claim 11, characterised in that the shielding of the load-bearing yoke (22) includes a respective canvas element (36) actuated by the load-bearing yoke (22) wherein there are embedded magnetic particles, there being mounted on the main guide rail (4) magnets which will hold the canvas element (36) in place on the main guide rail so that it covers the guideway.

13. The derrick according to claim 12, characterised in that the load-bearing yoke (22) includes rollers (38–41) which interact with the canvas element (36) and force this away from the main guide rail (4) and put it in place again as the load-bearing yoke (22) moves along the main guide rail (4).

14. A derrick according to any one of the preceding claims, characterised in that the driving gear is made in the form of a heave compensation system.

15. The derrick according to claim 1, wherein the derrick structure is a drilling rig derrick.

* * * * *